US007967387B2

(12) United States Patent
Langhorn

(10) Patent No.: US 7,967,387 B2
(45) Date of Patent: Jun. 28, 2011

(54) ACCESSORY FOOTREST ATTACHMENT

(76) Inventor: Peter Langhorn, Lake Forest, CA (US)

( * ) Notice: Subject to any disclaimer, the term of this patent is extended or adjusted under 35 U.S.C. 154(b) by 147 days.

(21) Appl. No.: 12/352,550

(22) Filed: Jan. 12, 2009

(65) Prior Publication Data

US 2009/0224591 A1 Sep. 10, 2009

Related U.S. Application Data

(60) Provisional application No. 61/062,185, filed on Jan. 23, 2008.

(51) Int. Cl.
*A47C 7/52* (2006.01)

(52) U.S. Cl. ..... 297/423.4; 297/423.25; 297/423.38

(58) Field of Classification Search ..... 297/423.25, 297/423.26, 423.27, 423.38, 423.4
See application file for complete search history.

(56) References Cited

U.S. PATENT DOCUMENTS 315,779 A * 4/1885 Haynes ..... 297/423.2
2,177,174 A * 10/1939 Eccles ..... 297/423.45
2,546,871 A * 3/1951 Schley ..... 297/423.38
2,767,774 A * 10/1956 Derby ..... 297/149
2,994,365 A 8/1961 Ziegler ..... 297/439
3,865,431 A * 2/1975 Zakhi ..... 297/217.1
4,626,030 A * 12/1986 Kassai ..... 297/423.19
4,782,916 A * 11/1988 Hays ..... 182/150
5,111,909 A * 5/1992 Liu ..... 182/150
5,302,003 A 4/1994 Xenofos ..... 297/423.44
5,836,652 A * 11/1998 Wexler et al. ..... 297/423.28
6,478,380 B2 11/2002 Ehrlich ..... 297/423.46
7,360,840 B2 * 4/2008 Barlow et al. ..... 297/423.26
7,464,990 B2 * 12/2008 Collias ..... 297/256.16

* cited by examiner

*Primary Examiner* — Peter R. Brown
(74) *Attorney, Agent, or Firm* — Steins & Associates, P.C.

(57) ABSTRACT

An Accessory Footrest Attachment is disclosed. The footrest attachment is designed to give children and others having legs that are shorter than normal adult legs a rest for their feet. The attachment has at least two configurations—one for installation on a conventional vehicle seat and one for installation on a typical residential chair. In either configuration, the footrest attachment preferably has a flip-up footplate so that the device can be made compact for storage when not in use. Furthermore, the attachment includes an associated stabilizing mat that is designed to be captured between the seated user and the seat, and that would keep the footrest attachment in an upright and stable condition. The footrest attachment and associated stabilizing mat is height-adjustable to account for variance in user and chair sizes.

20 Claims, 9 Drawing Sheets

ACCESSORY FOOTREST ATTACHMENT

This application is filed within one year of, and claims priority to Provisional Application Ser. No. 61/062,185, filed Jan. 23, 2008.

BACKGROUND OF THE INVENTION

1. Field of the Invention

This invention relates generally to vehicle and residential furniture accessories and, more specifically, to an Accessory Footrest Attachment.

2. Description of Related Art

When riding in a car or sitting on a chair at home, children can frequently experience discomfort and cramping because their legs are too short for their feet to reach the ground. This causes their legs and feet to dangle without any physical support, thereby exerting undue pressure on the childs' thighs.

What is needed is a compact, portable, adjustable attachment for either automobile seats or chairs with legs (e.g. chairs for residential use) that will provide support for a child's feet so that the pressure on their legs caused by their dangling legs and feet will be eliminated.

SUMMARY OF THE INVENTION

In light of the aforementioned problems associated with the prior devices and accessories, it is an object of the present invention to provide an Accessory Footrest Attachment. The footrest attachment should be designed to give children and others having legs that are shorter than normal adult legs a rest for their feet. The attachment should have at least two configurations—one for installation on a conventional vehicle seat and one for installation on a typical residential chair. In either configuration, the footrest attachment should have a flip-up footplate so that the device can be made compact for storage when not in use. There should further be a stabilizing mat associated with the footrest that is designed to be captured between the seated user and the seat, and that would keep the footrest attachment in an upright and stable condition. The footrest attachment and associated stabilizing mat should be height-adjustable to account for variance in user and chair sizes.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Accessory Footrest Attachment.

Figure 1:
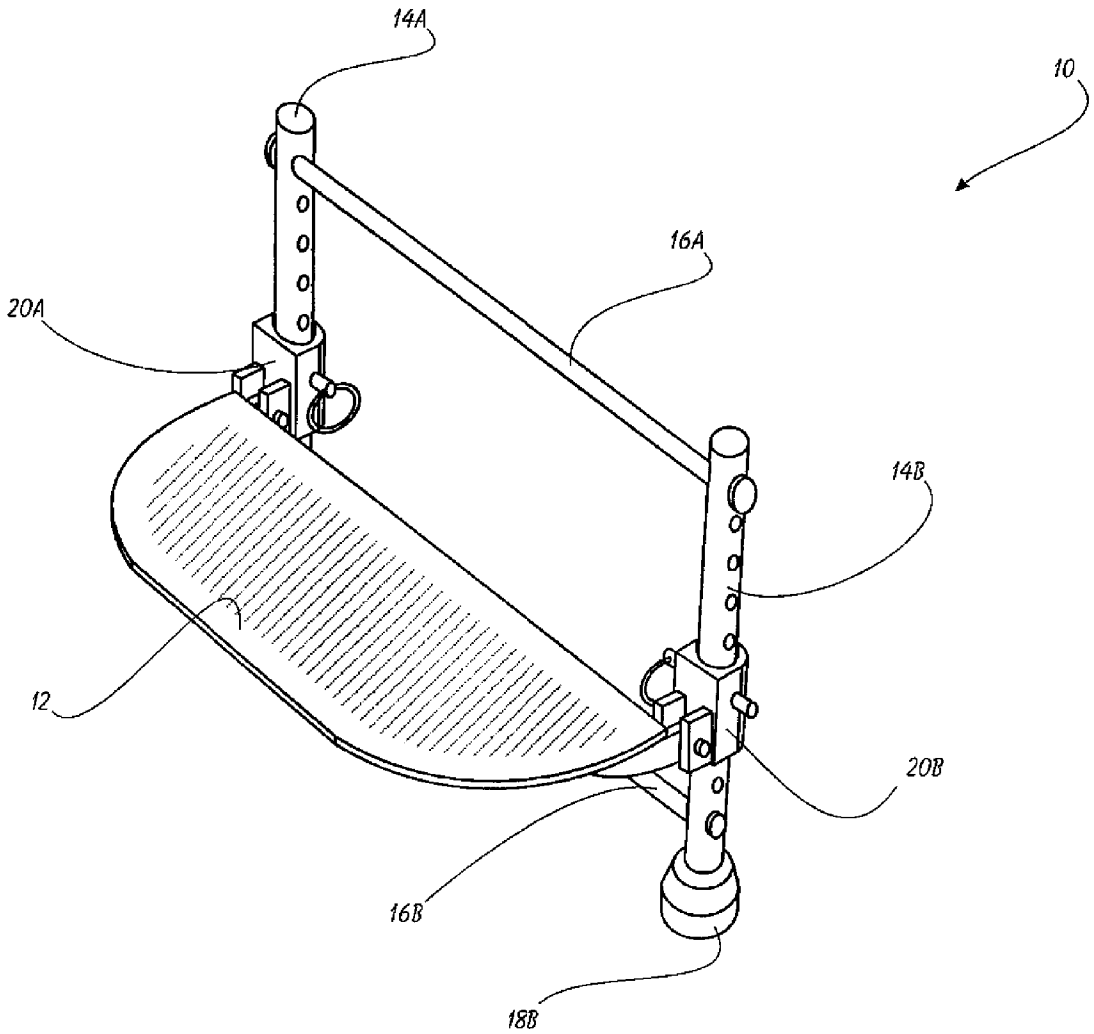
FIG. 1 is a perspective view of a preferred embodiment of the accessory footrest attachment of the present invention.

The present invention can best be understood by initial consideration of FIG. 1. FIG. 1 is a perspective view of a preferred embodiment of the accessory footrest attachment 10 of the present invention. The attachment 10 has two use modes: (a) a first arrangement (depicted here) that is designed to be attachable to a conventional vehicle seat; and (b) a second arrangement (depicted in later drawing figures) that is designed to be attachable to legged chairs, such as those used for residential seating. The second arrangement is achieved by simply adding elements to the attachment 10 depicted in this FIG. 1.

The attachment 10 has a flip-up footplate 12 that provides a place for a child to place his or her feet (when the child's legs are too short to reach the floor of the vehicle). The frame of the attachment 10 is formed from a first post 14A and a second post 14B (extending generally vertically). The two posts 14A, 1413 are maintained in spaced relation by an upper crossbar 16A and a lower crossbar 1613. The footplate 12 is pivotally attached to a first pivot trolley 20A and a second pivot trolley 20B. The pivot trolleys 20A, 20B can slide up and down the length of the posts 14A, 14B (and then pinned in place) so that the height of the footplate 12 can be adjusted to adapt to a variety of leg lengths.

In order to prevent the attachment 10 from slipping out from under the child, each post 14A and 14B terminates at its lower end in a foot (second foot 18B shown here). Additional detail regarding the attachment 10 is provided in FIG. 2.

Figure 2:
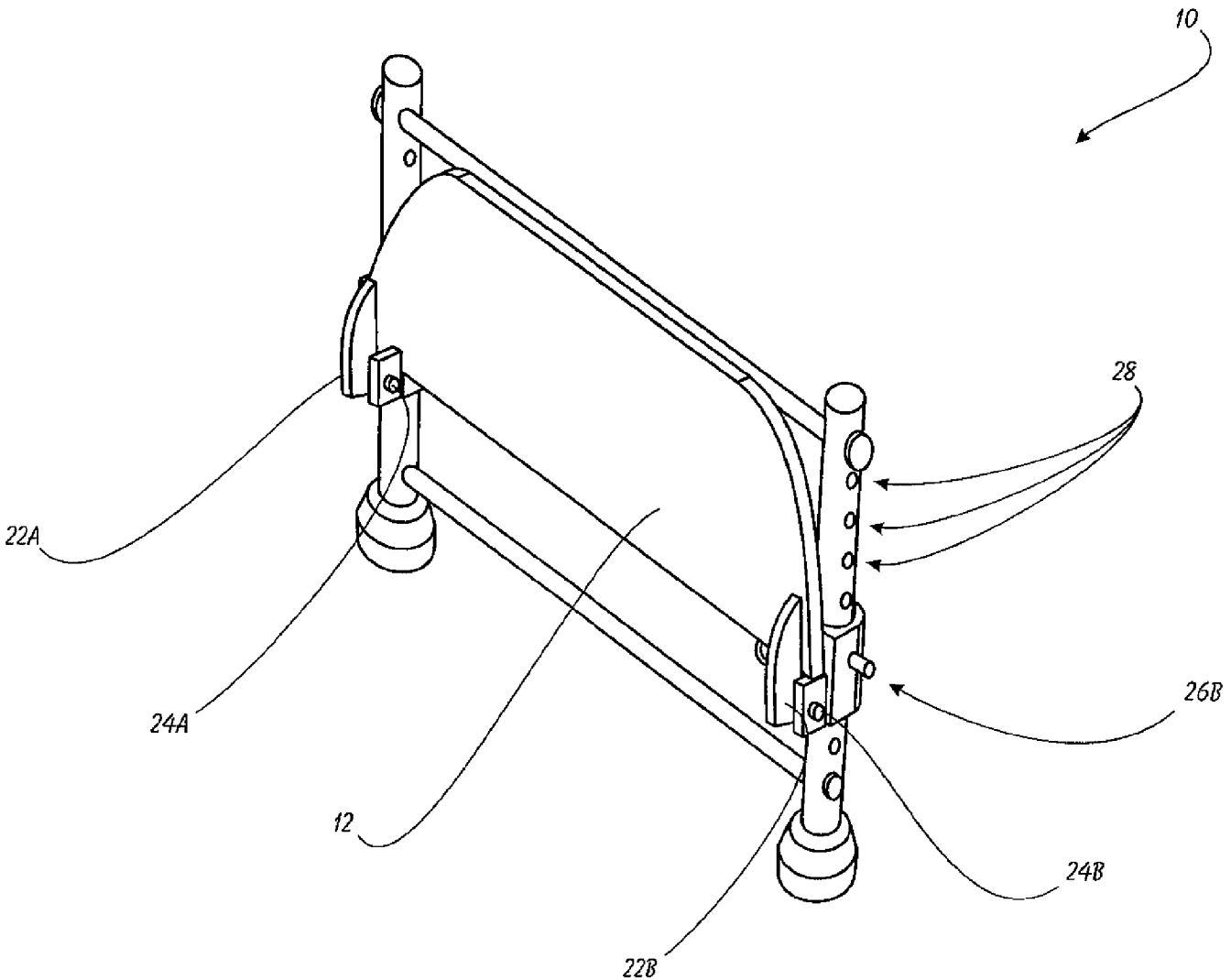
FIG. 2 is another perspective view of the attachment of FIG. 1.

FIG. 2 is another perspective view of the attachment 10 of FIG. 1. Here, the footplate 12 has been flipped up so that additional structure can be seen. The footplate 12 is pivotally attached to the first and second pivot trolleys 20A, 20B via a pair of structural members identified as a first plate strut 22A and a second plate strut 22B. The plate struts 22A, 22B are part of (or otherwise rigidly attached to) the footplate 12. The struts 22A, 22B are depicted here as being generally triangularly-shaped protrusions from the bottom side of the footplate 12. The plate struts 22A, 22B pivot about first and second pivot pins 24A, 24B. The pins 24A, 24B are removable if disassembly of the attachment 10 is desired.

As discussed previously, the pivot trolleys 20A and 20B are height-adjustable along the length of the first and second post (14A, 14B). The structure facilitating this adjustability is the first and second trolley pins 26A (not shown) and 26B, respectively. The trolley pins 26A, 26B insert through apertures formed in the trolleys 20A, 20B, as well as through pin apertures 28 formed in spaced relation along the posts (14A, 14B). To adjust the position of the trolleys 20A, 20B, it is a simple matter of removing the two trolley pins 26A, 26B, sliding the trolleys 20A, 20B to their desired position, and then inserting the pins 26A, 26B through the apertures 28. If we now turn to FIG. 3, we can examine the entire assembly of the present invention as it would be used on a vehicle seat.

Figure 3:
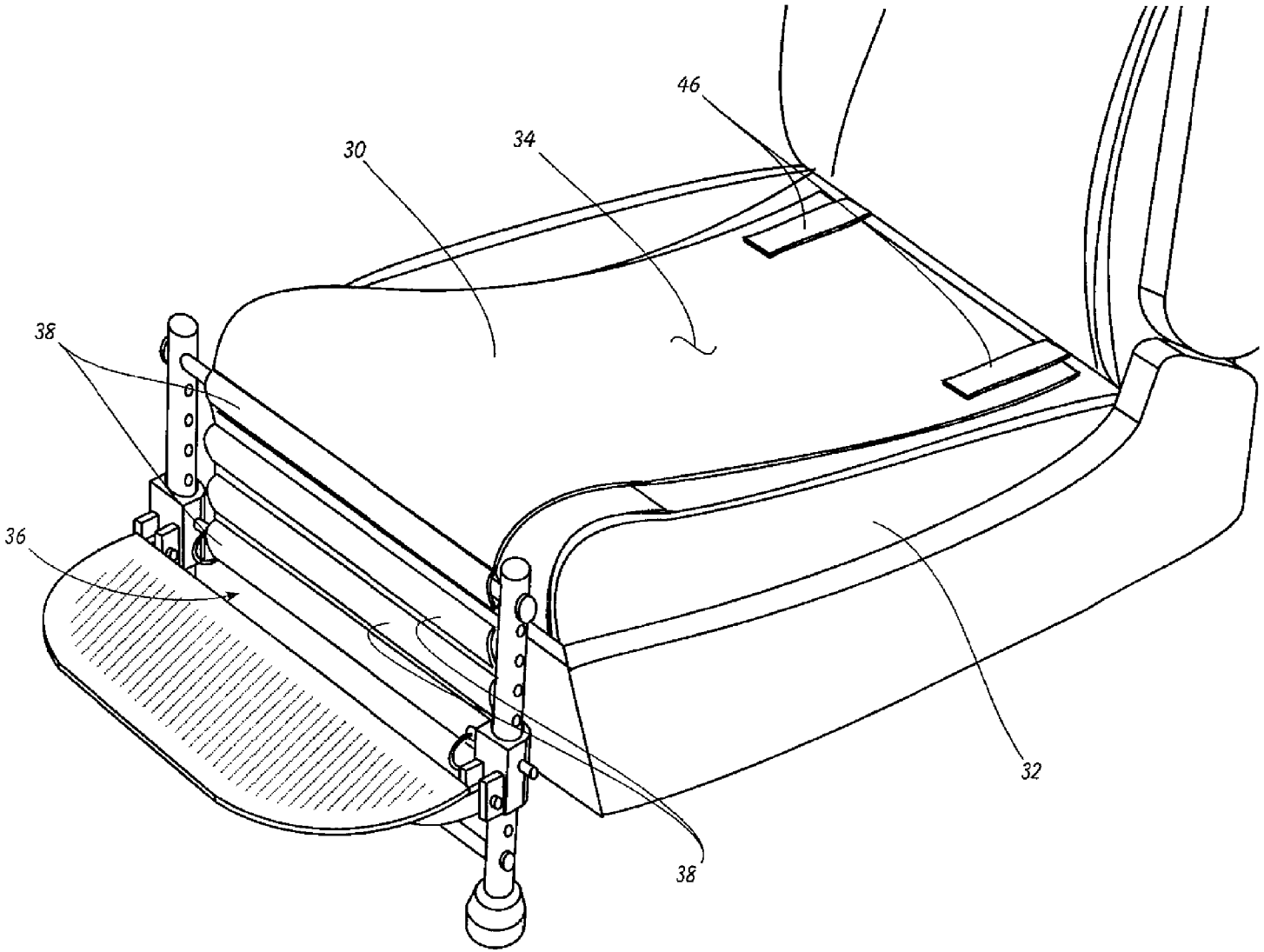
FIG. 3 is a perspective view of the device of FIGS. 1 and 2 installed on a conventional vehicle seat.

FIG. 3 is a perspective view of the device 10 of FIGS. 1 and 2, including the stabilizing mat 30, as it would be installed on a vehicle seat. The mat 30 comprises a seat bottom portion 34 and a seat front portion 36. The seat front portion 36 is designed to lay over the front of the vehicle seat 32. The upper crossbar (see FIG. 1) of the attachment 10 has been slid through one of five available crossbar sleeves 38 formed in relative parallel orientation at the bottom end of the seat front portion 36 of the stabilizing mat 30.

Figure 4:
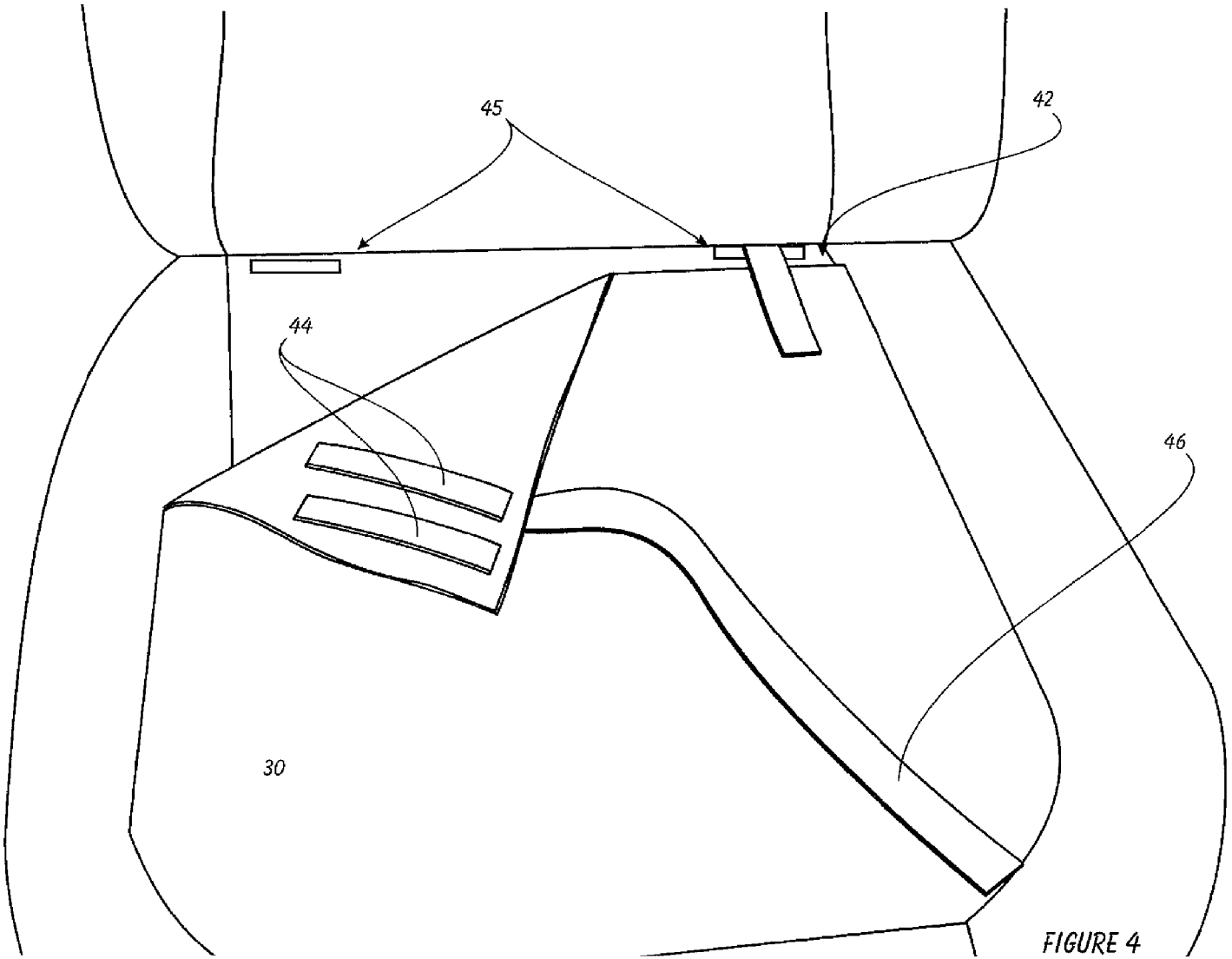
FIG. 4 is a front view of the device installation of FIG. 3.

The seat bottom portion 34 is designed to lay atop the vehicle seat 32. The vehicle seat 32 shown here is one from a later model vehicle, wherein a pair of child safety seat tethers 45 are provided at the seat 32 corners (see also FIG. 4) the tethers 45 are a mandatory requirement provided by manufacturers for use in attaching a child safety seat to the vehicle seat 32. When the footrest attachment of the present invention is in use, it would be in lieu of a child safety seat (which has its own built-in footrest), and therefore the tethers 45 would be free for use. When the child sits on the chair seat 32, the seat bottom portion 34 will be captured underneath the child. This will keep the attachment 10 snug and stable against the front of the chair seat 32. FIG. 4 shows additional features of the stabilizing mat 30.

FIG. 4 is a front view of the device installation of FIG. 3. The distal (or upper) edge 42 of the mat 30 is configured to tuck tight up to the seat back of the vehicle seat atop which the device 10 is attached. There are fastener straps 46 extending from each corner of the distal edge 42 of the mat 30. The straps 46 are designed to either attach to the tethers 45 (if a late model vehicle), or, alternatively, wrap around the framework supporting the seatback of the chair. Fastener pads 44 are also dispersed on the bottom side of the mat 30 so that the straps 46 can wrap around the seat frame at the corners and then stick back to the fastener pads 44. The straps 46 and fastener pads 44 are preferably covered with hook and loop fastener material to provide extensive adjustability.

At the proximal end 40 (see FIG. 8) of the mat 30, the mat has one of five transverse sleeves 38 formed within it (see also FIG. 3). The sleeves are designed to accept the upper crossbar (see FIG. 1) through it so that the attachment 10 and mat 30 are securely attached to one another; the option of five different sleeves 38 provides additional height adjustment for different seat sizes. If we now turn to FIG. 5, we can examine the additional elements that serve to convert the device 10 from one for installation in a vehicle to a device suitable for installation on a standard chair with legs.

Figure 5:
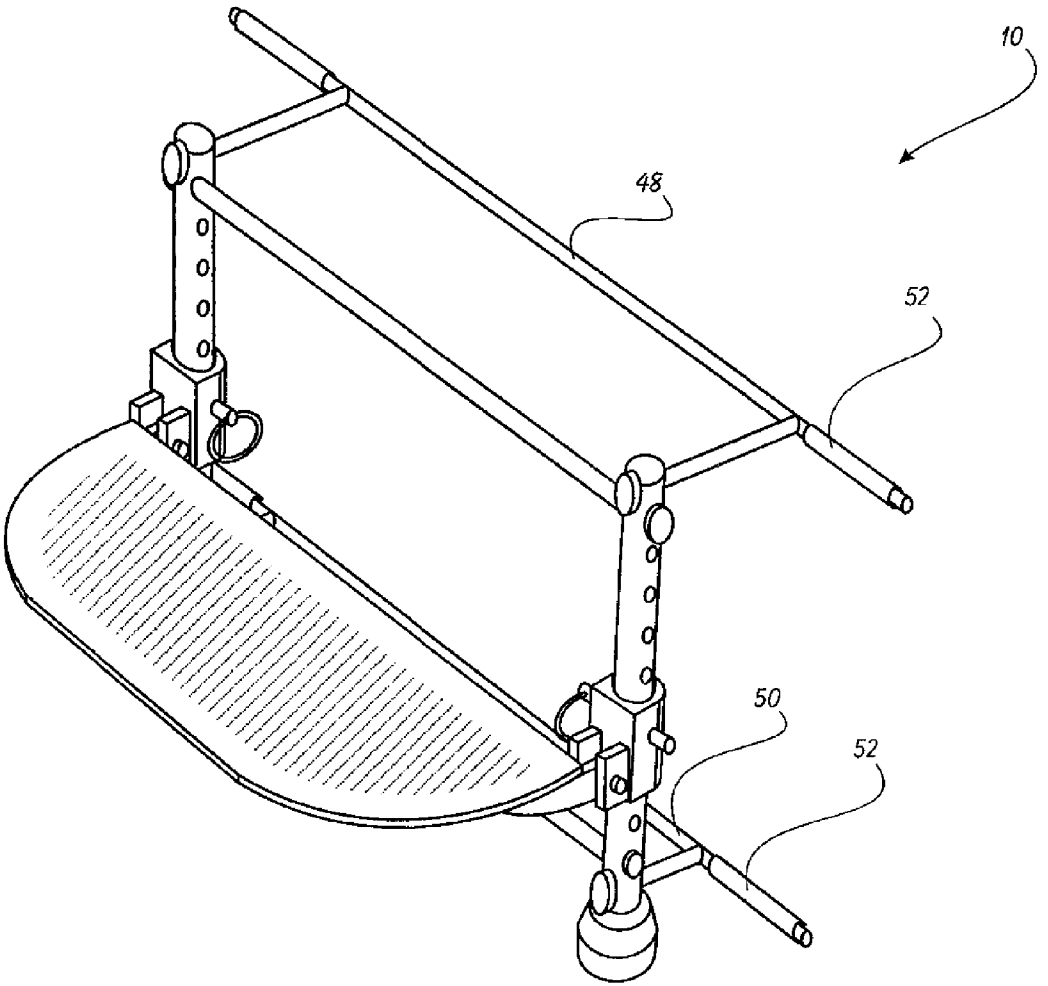
FIG. 5 is a perspective view of the device of FIGS. 1-4 including the crossbars for legged chair attachment.

FIG. 5 is a perspective view of the device of FIGS. 1-4 including the crossbars for legged chair attachment. Review of the device of FIG. 1 as compared to that depicted here reveals that the basic device is the same, but with the addition of a retaining crossbar 48 at the upper end of the posts 14A, 14B. The purpose of the retaining crossbar 48 is to hook behind the front legs of the chair to which the device 10 is being attached. Hooking the ends of the retaining crossbar 48 behind the chair legs will hold the device 10 tight against the chair. The ends of the retaining crossbar 48 are preferably coated with cushioning sleeves 52 in order to protect the surface of the chair legs. In this version, the cushioning sleeves 52 are made from a rubberized material that the crossbar 48 is dipped in.

At the lower end of the posts 14A, 14B, a standoff crossbar 50 extends backwardly. The standoff crossbar 50 creates a separation between the bottom of the posts 14A, 14B and the bottom of the chair legs. This will enable the device to stand upright (since most times the chair seating member overhangs the front of the legs of the chair. The ends of the standoff crossbar 50 are also preferably provided with cushioning sleeves 52. The spacing of the crossbars 48, 50 from the posts 14A, 14B is accomplished with the structure depicted in FIG. 6.

Figure 6:
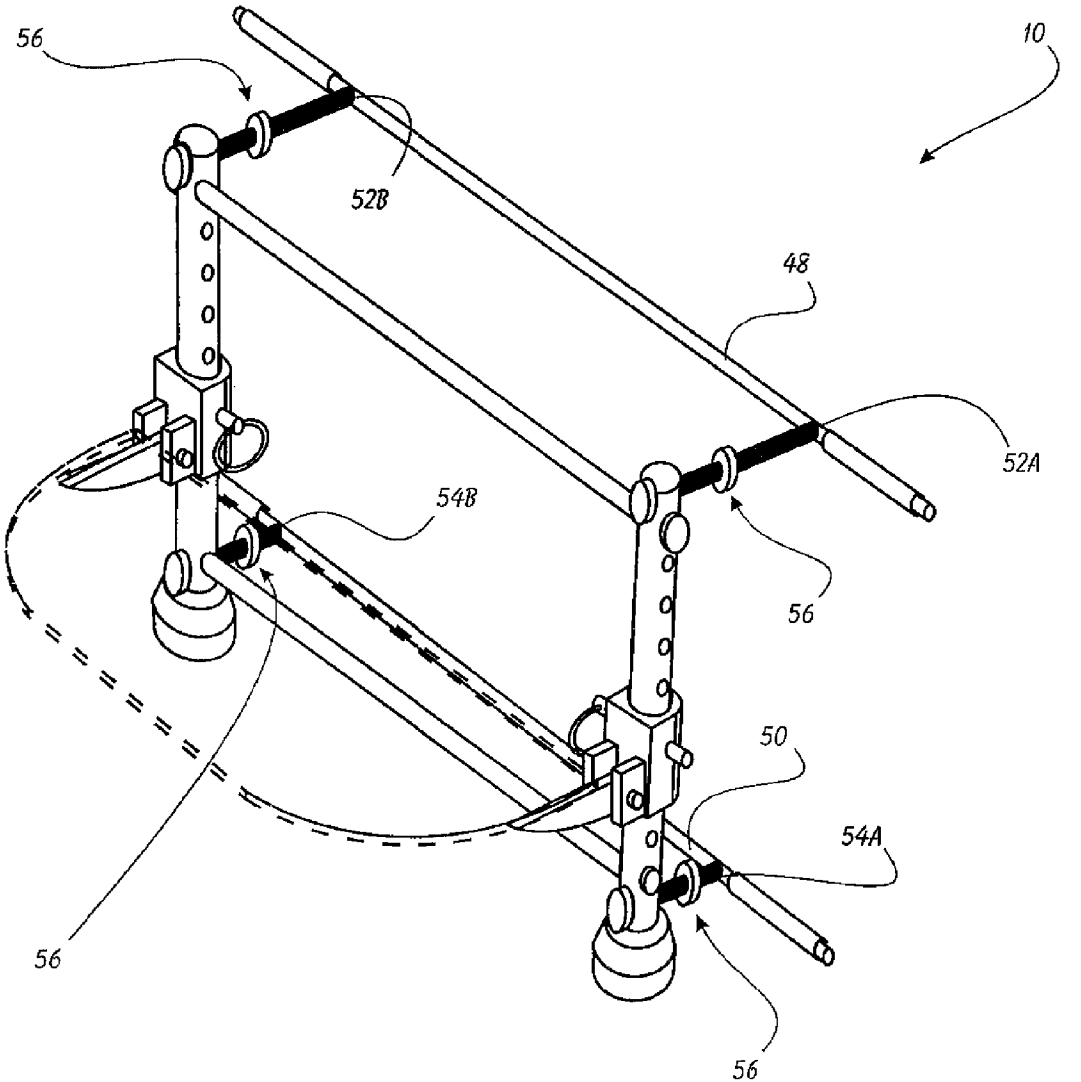
FIG. 6 is a second perspective view of the device configured as in FIG. 5.
Figure 7:
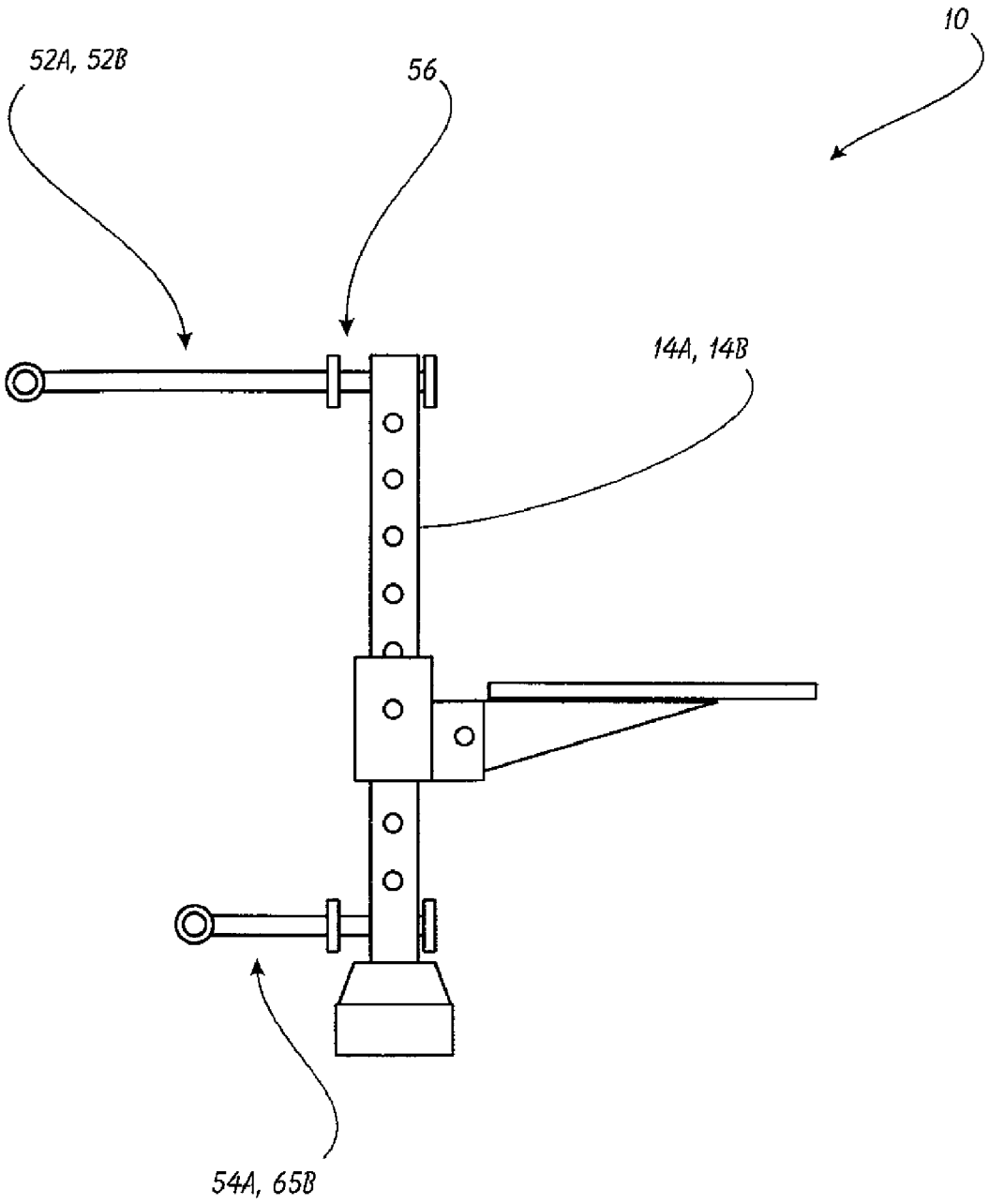
FIG. 7 is a side view of the device configured as in FIGS. 5 and 6.

FIG. 6 is a second perspective view of the device of FIG. 5. As shown here, the retaining crossbar 48 extends backwardly from the upper ends of the posts 14A, 14B. The crossbar 48 connects with the posts 14A, 14B by first and second retaining crossbar struts 52A, 52B. The standoff crossbar 50 is attached to the lower ends of the posts 14A, 14B by first and second standoff struts 54A, 54B. In this embodiment, the standoff struts 52A, 52B, 54A, 54B are elongate bolt-shaped elements having threads formed on the outside of at least one end (the end attached to the posts 14A, 14B). The adjustment nuts 56 for the standoff struts 54A, 54B are shown here. Once the struts 54A, 54B are adjusted to the appropriate length, the adjustment nuts 56 are snugged down against either side of the posts 14A, 14B to keep the struts 54A, 54B at their desired lengths. Turning now to FIG. 7 to examine the final elements of the device 10.

FIG. 7 is a side view of the device 10 of FIGS. 5 and 6. As shown here, the standoff struts 54A, 54B and the retaining crossbar struts 52A, 52B all engage the posts 14A, 14B through special apertures formed in the posts 14A, 14B. Similar to the standoff struts 54A, 54B, the retaining crossbar struts 52A, 52B are set and maintained in their desired position relative to the posts 14A, 14B by the adjusting nuts 56.

The setting and securing of the length of the struts 52A, 52B, 54A, 54B could be accomplished by a variety of adjustment/securing structures; the depicted structure is only exemplary.

Figure 8:
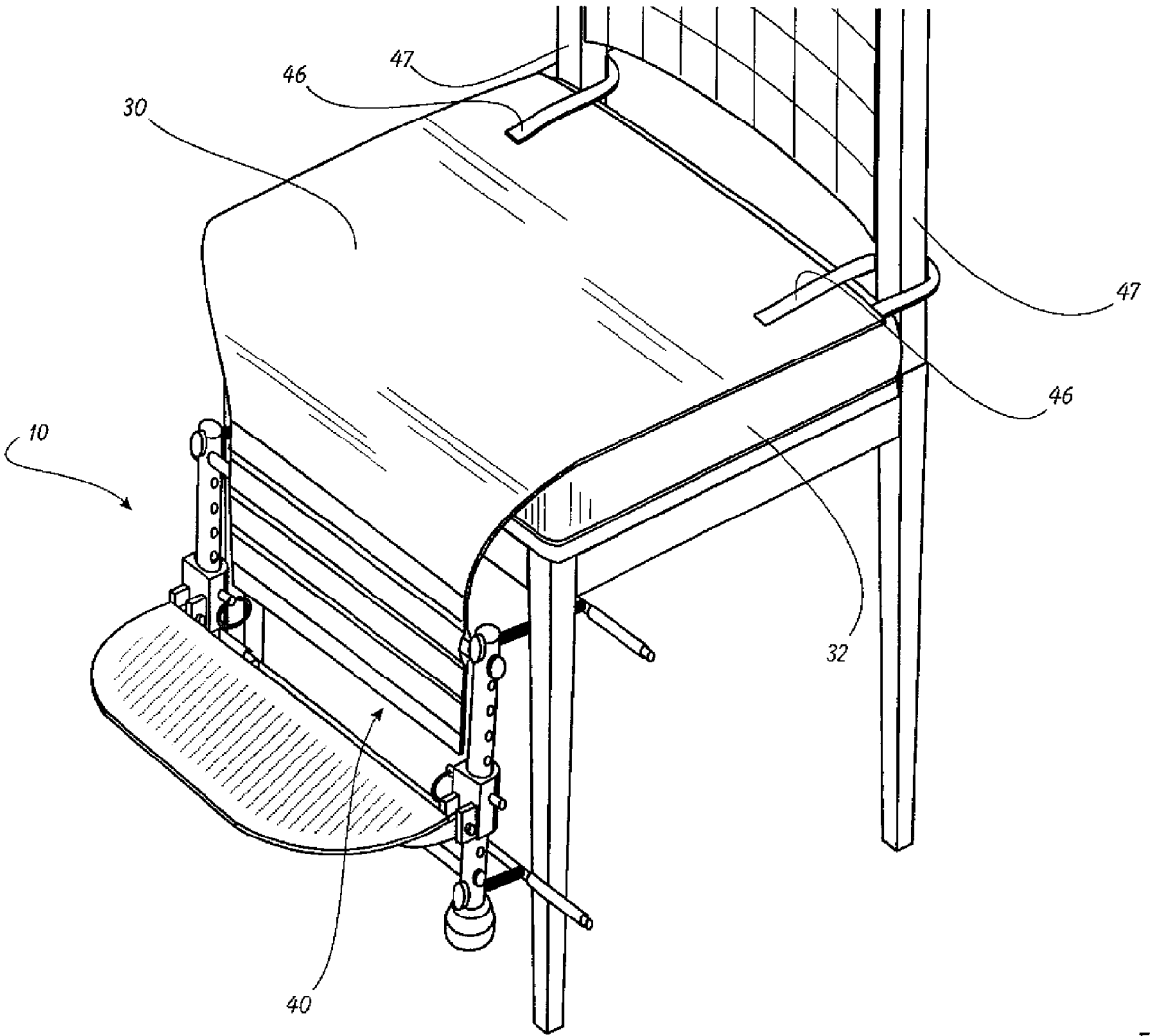
FIG. 8 is a perspective view of the device configured as in FIGS. 5-7 installed on a legged chair.
Figure 9:
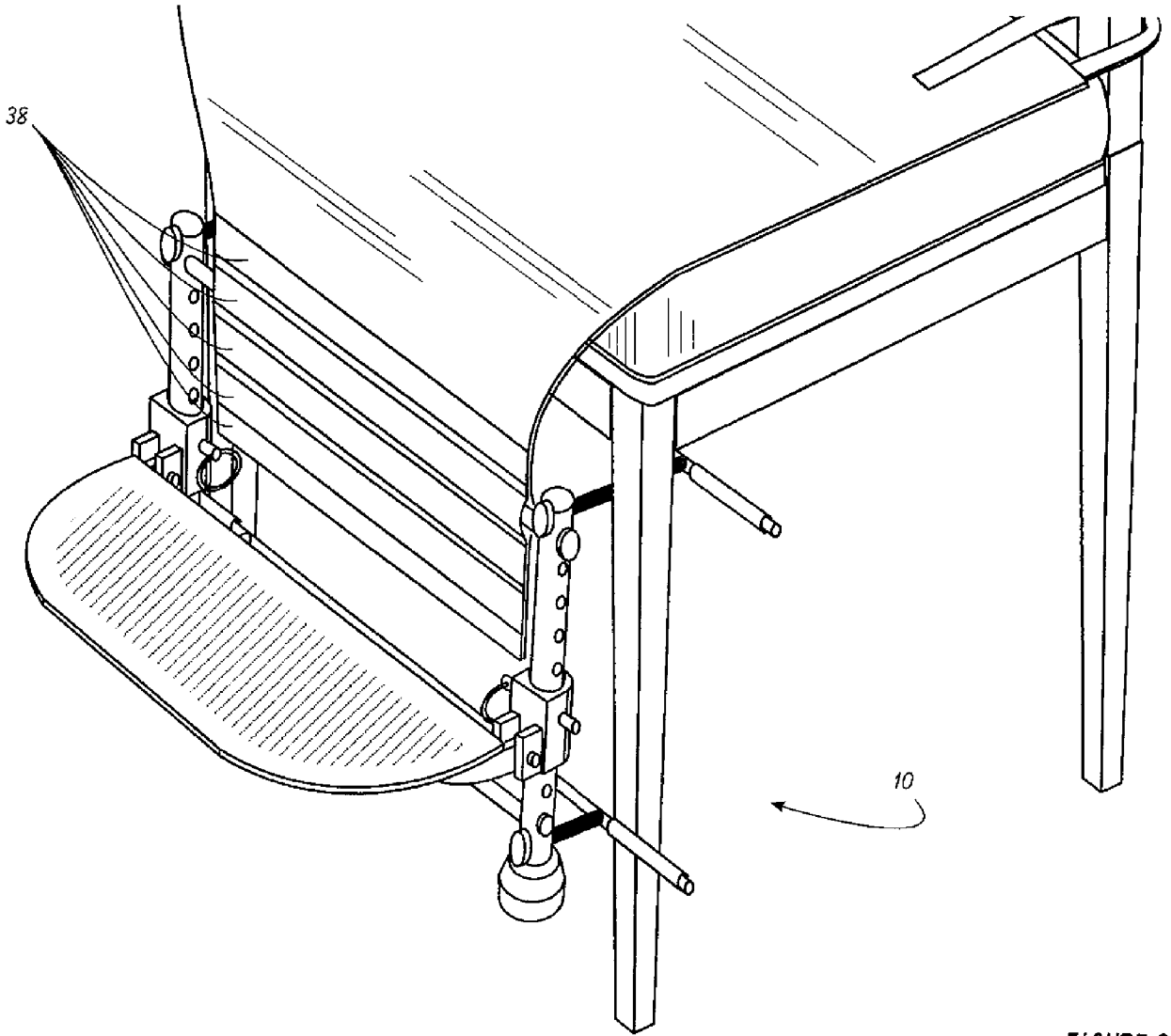
FIG. 9 is a second perspective view of the device configured as in FIGS. 5-8 installed on a legged chair.

FIGS. 8 and 9 each provide additional views of the present invention as configured and installed on a conventional legged chair. As shown, the fastener straps 46 have been wrapped around the seat-back posts 47 in order to hold the mat 30 snugly in place on the seat bottom. In FIG. 9, we can see the purpose of the crossbar sleeves 38 in adjusting for chair height.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A footrest device, comprising:

a first post defining upper and lower ends;

a second post defining upper and lower ends, said second post in parallel spaced relation to said first post;

an upper crossbar interconnecting said first post to said second post;

a lower crossbar interconnecting said first post to said second post, said crossbars in parallel spaced relation;

a first pivot trolley associated with said first post;

a second pivot trolley associated with said second post;

a footplate extending from said first and second pivot trolleys, and a flat flexible stabilizing mat for laying over a surface of an adjacent seat, said mat attachable to said upper crossbar.

2. The device of claim 1, wherein said footplate is pivotally attachable to said first and second pivot trolleys.

3. The device of claim 2, wherein said pivot trolleys slidingly engage said posts.

4. The device of claim 3, further comprising:

a first trolley pin engaging one or more apertures formed in said first pivot trolley, said first trolley pin further engaging cooperating pin apertures formed in said first post; and a second trolley pin engaging one or more apertures formed in said second pivot trolley, said second trolley pin further engaging cooperating pin apertures formed in said first post.

5. The device of claim 4, wherein said stabilizing mat comprises a seat bottom portion and a seat front portion, said seat front portion further defined by one or more crossbar sleeves associated therewith, each said crossbar sleeve cooperatively formed to accept said upper crossbar therethrough.

6. The device of claim 5, further comprising a retaining crossbar in parallel spaced relation to said upper and lower crossbars, said retaining crossbar attached to said first and second posts by retaining struts extending generally perpendicular therefrom.

7. The device of claim 6, further comprising a standoff crossbar in parallel spaced relation to said upper and lower crossbars, said standoff crossbar attached to said first and second posts by standoff struts extending therefrom in a direction generally the same as said retaining crossbar.

8. The device of claim 7, wherein said retaining struts attach to said posts to position said retaining crossbar at a retaining distance from said posts, said retaining distance being adjustable by adjusting the length that said retaining struts extend from said posts.

9. The device of claim 8, wherein said standoff struts attach to said posts to position said standoff crossbar at a standoff distance from said posts, said standoff distance being adjustable by adjusting the length that said standoff struts extend from said posts.

10. The device of claim 9, wherein said retaining distance and said standoff distance are adjusted by adjusting adjustment nuts that are threadedly engaging said retaining struts and said standoff struts.

11. A footrest attachment for existing chairs, comprising:

a right post defining upper and lower ends;

a left post defining upper and lower ends, said second post in parallel spaced relation to said first post;

an upper crossbar interconnecting said right post to said left post;

a lower crossbar interconnecting said right post to said left post, said crossbars in parallel spaced relation;

a left pivot trolley slidingly engaging said left post;

a right pivot trolley slidingly engaging said right post;

a footplate extending from said right and left pivot trolleys; and a flat flexible stabilizing mat configured to lay over a portion of a said existing chair, said mat engagable to said upper crossbar.

12. The device of claim 11, wherein said stabilizing mat comprises a seat bottom portion and a seat front portion, said seat front portion further defined by one or more crossbar sleeves associated therewith, each said crossbar sleeve cooperatively formed to accept said upper crossbar therethrough.

13. The device of claim 12, wherein, wherein said seat bottom portion is further defined by at least one fastener strap extending from said seat bottom portion adjacent to an edge of said seat bottom portion opposite said seat front portion.

14. The device of claim 13, wherein said footplate is pivotally attachable to said right and left pivot trolleys, each by a pivot pin associated therewith.

15. The device of claim 14, further comprising:

a right trolley pin engaging one or more apertures formed in said right pivot trolley, said right trolley pin further engaging cooperating pin apertures formed in said right post; and a left trolley pin engaging one or more apertures formed in said left pivot trolley, said left trolley pin further engaging cooperating pin apertures formed in said left post.

16. The device of claim 15, further comprising a retaining crossbar in parallel spaced relation to said upper and lower crossbars, said retaining crossbar attached to said right and left posts by retaining struts extending therefrom.

17. The device of claim 16, further comprising a standoff crossbar in parallel spaced relation to said upper and lower crossbars, said standoff crossbar attached to said right and left posts by standoff struts extending therefrom.

18. The device of claim 17, wherein said retaining struts attach to said posts to position said retaining crossbar at a retaining distance from said posts, said retaining distance being adjustable by adjusting the length that said retaining struts extend from said posts.

19. A footrest attachment for existing chairs, comprising:

a right post defining upper and lower ends;

a left post defining upper and lower ends, said second post in parallel spaced relation to said first post;

an upper crossbar interconnecting said right post to said left post;

a lower crossbar interconnecting said right post to said left post, said crossbars in parallel spaced relation;

a left pivot trolley slidingly engaging said left post;

a right pivot trolley slidingly engaging said right post;

a footplate extending from said right and left pivot trolleys; and a retaining crossbar in parallel spaced relation to said upper and lower crossbars, said retaining crossbar attached to said right and left posts by retaining struts extending generally perpendicular therefrom.

20. The attachment of claim 19, further comprising a standoff crossbar in parallel spaced relation to said upper and lower crossbars, said standoff crossbar attached to said right and left posts by standoff struts extending generally perpendicular therefrom.

* * * * *